United States Patent [19]

Champigny

[11] Patent Number: 4,534,447

[45] Date of Patent: Aug. 13, 1985

[54] FOLDABLE LADDER SCAFFOLD

[76] Inventor: Lucien Champigny, 1420 St. Elzéar Blvd., West Chomedey, Canada, H7L 3N2

[21] Appl. No.: 596,501

[22] Filed: Apr. 3, 1984

[51] Int. Cl.[3] ..... E04G 1/34; E04G 1/20

[52] U.S. Cl. ..... 182/152; 182/119; 182/222

[58] Field of Search ..... 182/152, 119, 222, 223, 182/178, 179

[56] References Cited

U.S. PATENT DOCUMENTS

| | | | |
|---|---|---|---|
| 1,943,871 | 1/1934 | Landberg | 182/152 |
| 2,982,379 | 5/1961 | Fisher | 182/152 |
| 2,994,402 | 8/1961 | Tyler | 182/152 |
| 3,207,260 | 9/1965 | Castagna | 182/152 |
| 3,212,605 | 10/1965 | Dickerson | 182/152 |
| 3,235,038 | 2/1966 | Nesslinger | 182/152 |
| 3,434,567 | 3/1969 | Wilkins | 182/222 |
| 3,504,768 | 4/1970 | Boyd | 182/152 |
| 3,509,966 | 5/1970 | Sarno | 182/119 |

*Primary Examiner*—Reinaldo P. Machado

[57] ABSTRACT

A foldable scaffold is disclosed, including a frame and a person-supporting plank. The frame comprises two upwardly-extending end ladders. A backwardly-located truss pivotally joins the ladders together and includes a hinge at the intermediate portion thereof for pivotal forward movement of the latter from a fully-extended truss position to a folded truss position. The latter movement produces relative lateral movement of the ladders from spaced-apart positions, one toward the other, to near-abutting positions. The frame also includes a hinge to releasably immobilize the hinge and maintain the truss in fully-extended position. The person-supporting plank is removably fixed to and extends between the ladders when the truss in its fully-extended position.

3 Claims, 15 Drawing Figures

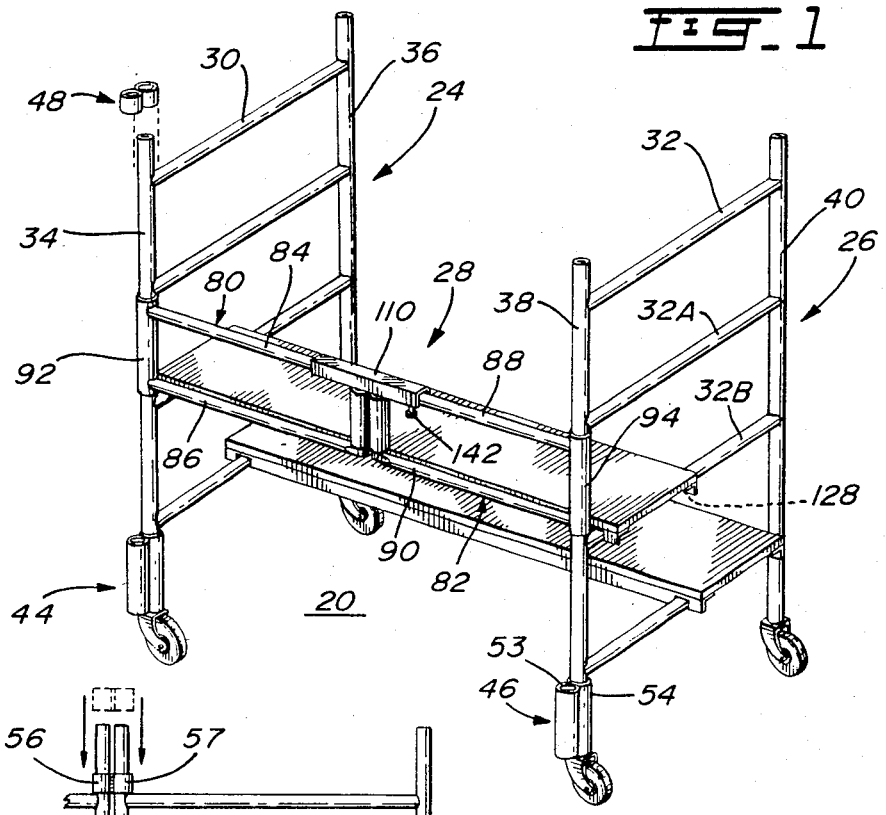
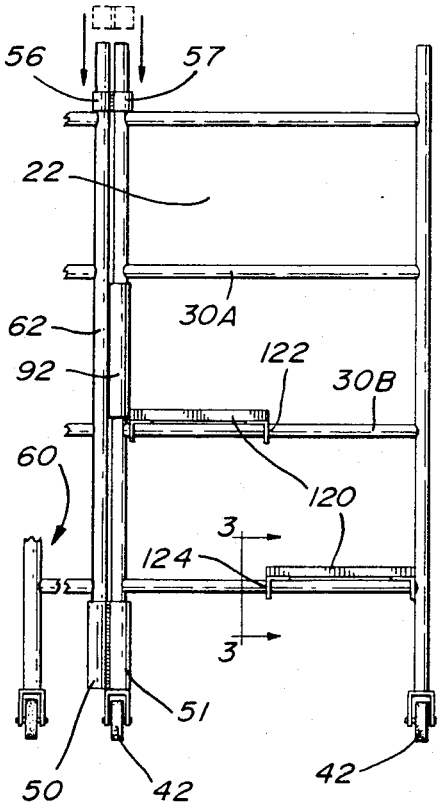
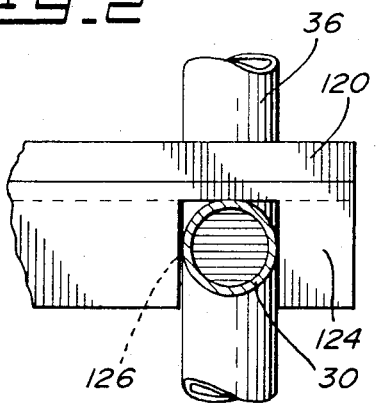
FIG. 3

FOLDABLE LADDER SCAFFOLD

FIELD OF THE INVENTION

This invention relates to a ladder scaffold.

BACKGROUND OF THE INVENTION

The ladder scaffolds available on the market comprise end ladders or stays assembled by bracing bars. Such scaffold frames take time to assemble and are cumbersome to use.

These scaffolds do not further include as standard equipment means to interconnect several scaffold frames, in order to construct larger-base scaffolds.

It is also found that workers have complained about plank instability on the rungs when the scaffold was displaced.

OBJECTS OF THE INVENTION

Accordingly, the gist of the invention is to provide a ladder scaffold which is foldable in any easy and compact manner, without sacrificing overall strength of the fully-extended structure.

Another object of the invention is to provide a ladder scaffold of the above type, wherein the scaffold frame is made of permanently-connected parts.

A further object of the invention is to provide a ladder scaffold of the above type, wherein the scaffold planks are securely connected to the ladder step rods during usage and serves to maintain the end stays in spaced-apart parallel position.

An important object of the invention is to provide a ladder scaffold of the above type, wherein the folded ladder scaffold is easily stored in a small area.

Still another object of this invention is to provide a ladder scaffold of the above type, wherein several frames may be interconnected endwise or fore and aft.

Other objects, advantages and capabilities of the present invention will become more apparent as the description proceeds, taken in conjunction with the following drawings.

SUMMARY OF THE INVENTION

With respect to the above-noted objects of the invention, a foldable scaffold is disclosed and includes a frame and a person-supporting means.

The frame comprises two upwardly-extending end ladders; a single, backwardly-located truss, pivotally joining the ladders together in spaced-apart relationship, and including hinge means at the intermediate portion thereof for pivotal forward movement of the latter from a fully-extended truss position to a folded truss position. The latter movement produces relative lateral movement of the ladders from spaced-apart positions, one toward the other, to near-abutting positions.

The frame also includes hinge means locking means to releasingly fixedly immobilize the hinge means against the forward movement of the truss intermediate portion, to rigidly maintain the truss in fully-extended position.

The person-supporting means is removably securely fixed to and extends between the ladders when the truss is in its fully-extended position and the locking means lock the hinge means.

BRIEF DESCRIPTION OF THE DRAWINGS

FIG. 1 is a rearwardly-looking perspective view of a ladder scaffold embodying features of the invention;

FIG. 2 is an end view of the scaffold of FIG. 1, shown connected to a second, partly broken-away, scaffold frame;

FIG. 3 is a cross-sectional view taken along line 3—3 of FIG. 2;

DETAILED DESCRIPTION OF THE DRAWINGS

Figure 5:
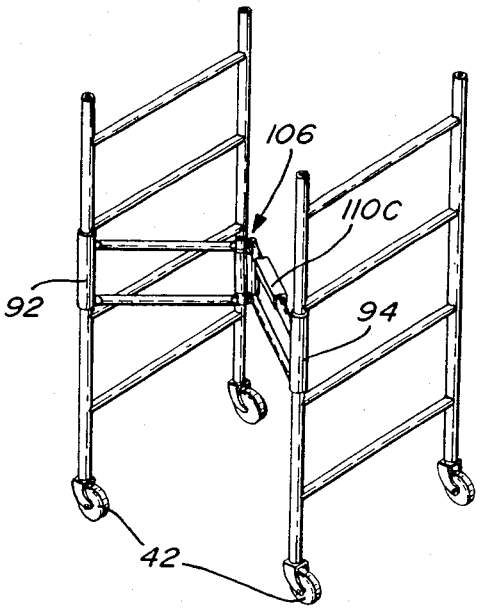
FIG. 5 is a perspective view of the ladder scaffold in partly folded state.
Figure 6:
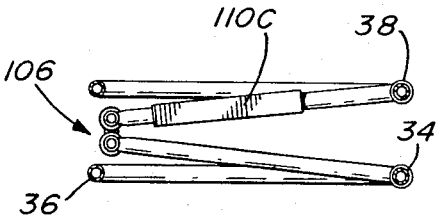
FIG. 6 is a top plan view of the ladder scaffold in completely folded state.
Figure 4:
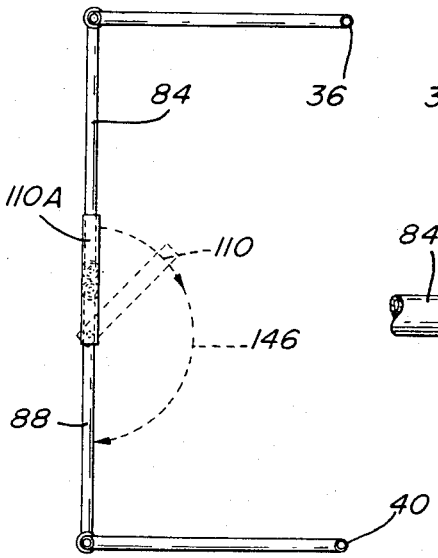
FIG. 4 is a top plan view of the ladder scaffold of FIG. 1, showing the pivotal movement of the channel member.
Figure 7:
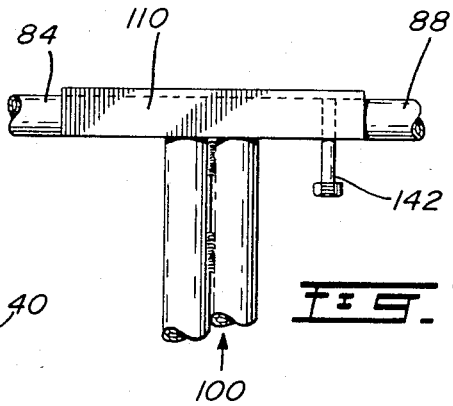
FIG. 7 is an enlarged plan view of the channel member of FIG. 1 over broken-away portions of the truss and the hinge means.

Referring to FIGS. 1 to 9 of the drawings, a ground-supported ladder scaffold is illustrated and is generally indicated by numeral 20. The scaffold 20 is constituted of a large open frame 22. The frame 22 comprises two upwardly-extending, spaced-apart end ladders 24, 26, joined together at mid-height by a horizontal, pivotable backwardly-located truss 28.

The ladders 24, 26 include a number of corresponding step rods 30, 32 joined together by two legs 34, 36, and 38, 40, respectively. Casters, preferably swivel butterfly brake-equipped casters 42, are rotatively mounted on the lower end of legs 34, 36, 38, 40, so as to allow easy displacement of the scaffold 20 over the ground or positive immobilization, whichever is desired.

Cylindrical, hollow, double tubes 44, 46 may be provided at the lower portions of the scaffold legs, such as legs 34, 38, respectively, and double tubes, such as a double tube 48 at an upper portion of the legs, such as leg 34. Each double tube 44, 46, 48 includes two hollow tubes 50 and 51, 53 and 54, and 56 and 57, respectively, which are being fixedly connected along their entire length.

Hollow tubes, 51, 54, 57 are designed to engage the legs 34, 38, 34, respectively of frame 22, whereas hollow tubes 50, 53, and 56 are designed to be engaged by the corresponding legs of another scaffold frame 60, such as leg 62 for tubes 50, 56. Hence, the combination of frames 22, 60 that occurs provides a scaffold of larger dimensions.

Figure 12:
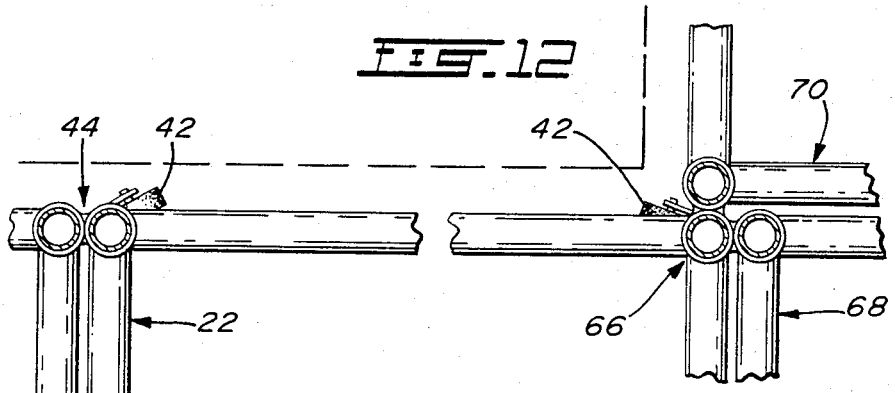
FIG. 12 is a partly broken-away, top plan section of a number of ladder scaffolds joined together according to the features of an embodiment of the invention.

FIG. 12 shows a higher number of frame combinations. On one side of frame 22, lateral scaffold frame 60 is combined therewith through double tubes, such as double tube 44. On the other side of frame 22, a triple tube 66 is provided, for combination with a second and third endwise and forward scaffold frames 68, 70, respectively.

The truss 28 comprises two end-connected rectangular members 80, 82. Members 80, 82 define two horizontal, upper and lower, long side bars 84, 86, and 88, 90 respectively; outer small side sleeves 92, 94, respectively, rotatably surrounding corresponding legs 34, 38 at mid-height thereof in between two ladder step rods 30A, 30B, and 32A, 32B, respectively; and lower small side rods 96, 98, respectively (see also FIG. 5). An additional double sleeve 100 is also provided, including two fixedly-interconnected hollow tubes 102, 104 rotatably surrounding rods 96, 98, respectively.

The double sleeve 100 and rods 96, 98, described above, therefore determine an intermediate hinge (FIG. 5).

Hence, ladders 24, 26 may be drawn one toward the other when the hinge 106 moves forwardly: rods 96, 98 will pivot within the interconnected hollow tubes 102, 104 and legs 34, 38 will pivot within hollow tubes 92, 94. The ladders 24, 26 may take a non-abutting but close position for easy transportation and storage.

To maintain the truss in fully-extended position, as shown in FIG. 1, a channel member 110, of U-shaped cross-section, is provided, surmounting the inner end portions of bars 84, 88. With the channel member 110, the frame 22 constitutes a rigid, elongated structure; without it, the frame 22 is foldable around hinge 100, thus constituting locked and unlocked positions.

When in extended and locked position, the frame 22 may support one or more planks, such as plywood boards 120, extending in between the two ladders 24, 26 over same level step rods 30, 32, respectively, or adjustable rungs (not shown) in between rods 32, 34. Each of the boards 120 has longitudinal iron angles 122, 124. The iron angles 122, 124 have recessed portions 26 (see also FIG. 13) in registry with step rods 32, 34 for engagement therewith.

Figure 8:
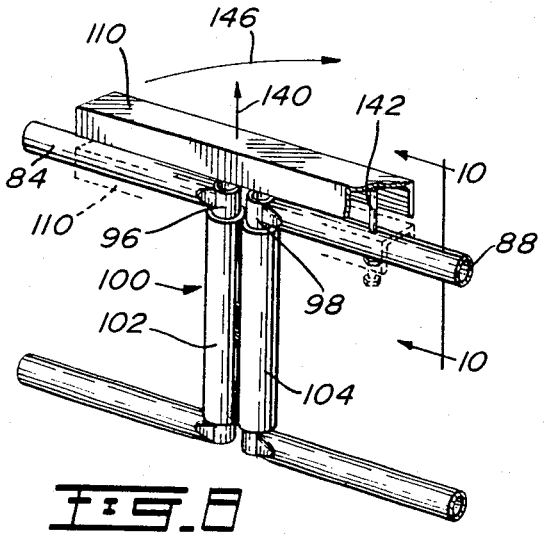
FIGS. 8 and 9 are perspective views of the channel member overlying the truss and its relative movement, before and after pivoting respectively.

Referring now more generally at FIGS. 4 to 11, it is shown how the scaffold 20 may be conveniently folded in accordeon-like fashion for easy storage in a small storage area. First, as shown in FIG. 8, the channel member 110 is to be lifted from bars 84, 88 along arrow 140. Channel member 110A is maintained connected to truss bar 88 through a pin 142 fixed to channel member 110 extending through corresponding bores in bar 88 and having at the other end a head 144 to prevent the channel member 110 from disengaging truss upper bar 88.

Figure 10:
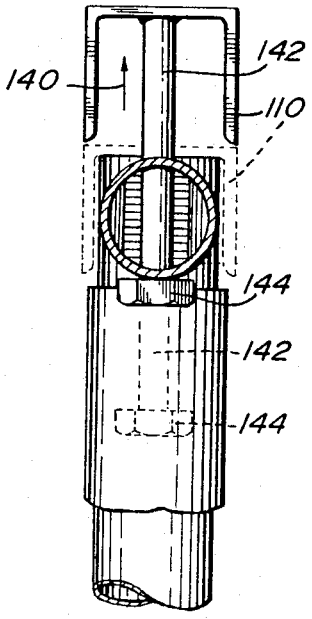
FIG. 10 is a cross-sectional view taken along line 10—10 of FIG. 8.

Hence, when the channel member 110 is upwardly lifted, pin 142 is drawn therewith, and head 144 takes the position shown in full lines in FIG. 10 and abuts on the wall of truss upper bar 88, further inhibiting upward movement of the channel member 110.

From then on, the channel member 110 may be pivoted around an axis determined by pin 142, along arrow 146, and, after a 180° rotation, the channel member 110 will surmount bar 88 along its entire length and may engage the same.

Figure 9:
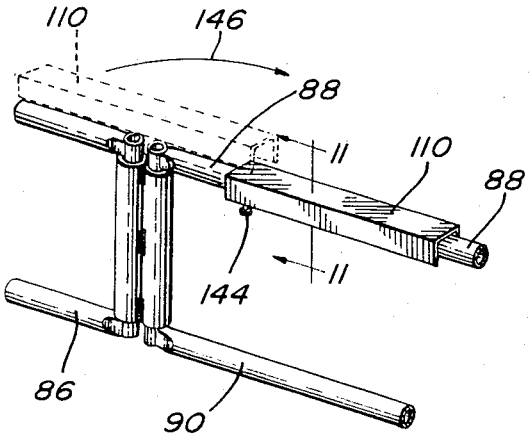
Figure 11:
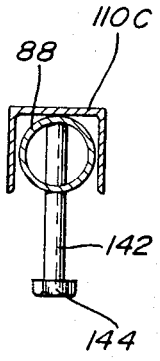
FIG. 11 is a cross-sectional view taken along line 11—11 of FIG. 9.

The scaffold 20 may be folded after the sequence shown in FIGS. 8, 9 has taken place. Folding can be done very rapidly without the use of any tool; the frame 22 is thereafter very compact and easily storable; it can be easily carried by one person thanks to casters 42; it may enter a car trunk and it is lightweight.

Figure 13:
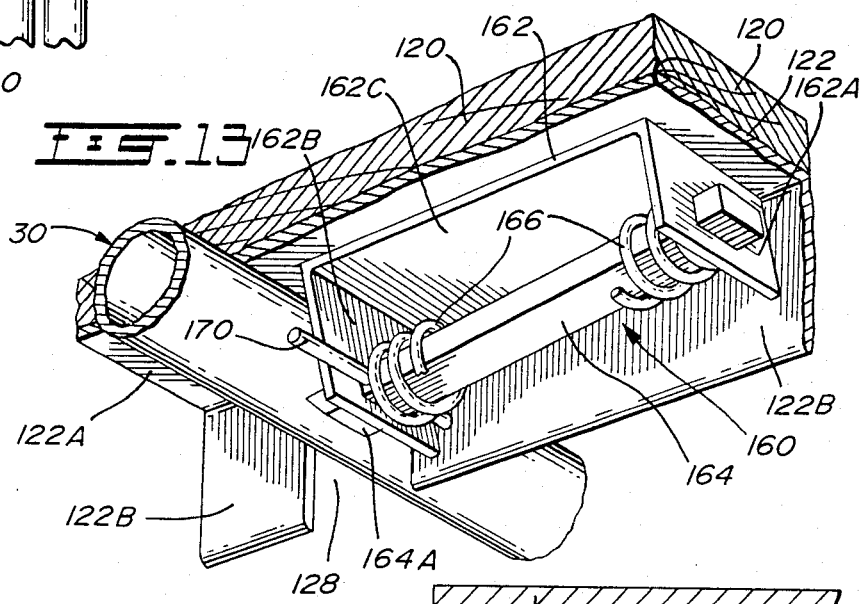
FIG. 13 is an upwardly-looking perspective view of the underside of a plank overlying a ladder step rod, and of the plank locking mechanism.
Figure 14:
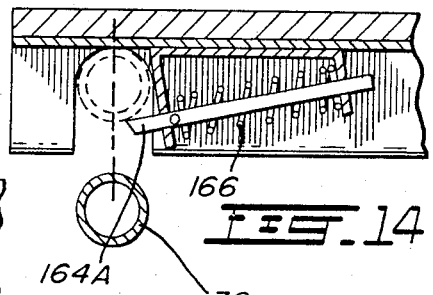
FIGS. 14 and 15 are longitudinal sections of the plank locking mechanism of FIG. 13, with the plank released and locked respectively.
Figure 15:
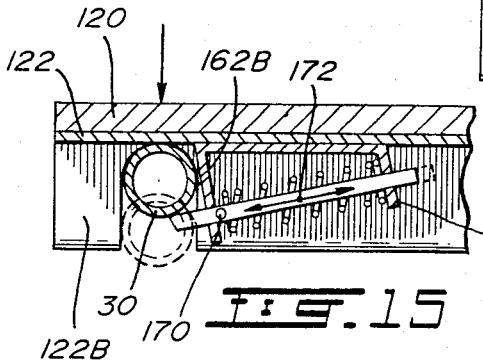

An additional feature of the invention is shown in FIGS. 13 to 15. The boards 120 abut by their own weight on step rods 30, 32; they are further maintained in place by the engagement of the recessed portions 126,128 of the boards iron angles 122, 124, at each end of the boards. The boards rigidly maintain the ladders in parallel relation. The boards may inadvertently upwardly disengage from the step rods should the scaffold produce a sudden movement during displacement of the same. This cannot be allowed in view of workers' security.

It is therefore provided to the scaffold 20 of the invention a board locking mechanism 160 for fixedly connecting a ladder step rod 30 or 32 to a board 120 used as a plank. The locking mechanism 160 comprises an open structure 162, of C-shaped longitudinal section, with two legs 162A, 162B. Structure 162 is fixed by its long side 162C on the iron-angle inner upper portion 122A, one leg 162B being adjacent recessed portion 128, preferably laterally abutting the iron-angle inner side portion 122B.

An elongated member 164, of rectangular cross-section, extends inwardly of structure 162, downwardly towards recessed portion 128, through structure legs 162A and 162B and protrudes outwardly thereof and is slidable therethrough. A coil spring 166 is provided around elongated member 164 inwardly of legs 162A, 162B to resiliently maintain the elongated member free end 164A outwardly protruding.

A draw pin 170 is fixed on elongated member 164 at right angles thereof. One end of spring 166 abuts pin 170, while its other end abuts leg 162A. Draw pin 170 maintains the free end 164A in an extended position in which it protrudes slightly less than half-way through the recessed portion 128 of iron angle 122. Free end 164A is bevelled, having its long edge on the side of iron angle inner upper portion 122A, while its short edge is opposite thereof.

One needs only to let board 120 drop on rod 30 at the level of recessed portion 128 to engage the same therewith, as shown in FIG. 14, since bevelled free end 164A will slidingly yield to pressure applied by the board on the rod. However, to disengage the board 120 from ladder rod 30, one needs to pull draw pin 170 outwardly relative to recessed portion 128, since the long edge of the bevelled free end 164A prevents any disengagement of the board from the rod.

What I claim is:

1. A foldable scaffold comprising two end ladders, each including a fore and an aft leg and a number of step rods extending between said fore and aft legs, a truss pivotally connected to said aft ladder legs at an intermediate portion of the latter, said truss being made of two sections and including hinge means interconnecting said sections for pivotal forward movement of said truss sections for a fully-extended truss position in which said sections are in end-to-end alignment to a folded truss position, said forward movement of said truss sections producing relative lateral movement of said end ladders from spaced-apart positions one toward the other to contiguous positions, and hinge means locking means to releasably fixedly imomobilize said truss sections in said fully-extended truss position, each truss section consisting of a rigid rectangular member comprising upper and lower horizontal parts interconnected by a vertical outer sleeve and a vertical inner rod, said sleeve rotatably surrounding said aft leg between two step rods of one said ladder, and said hinge means consisting of a double tube rotatably surrounding the adjacent vertical inner rods of the two rectangular members.

2. A foldable scaffold comprising two end ladders, each including a fore and an aft leg and a number of step rods extending between said fore and aft legs, a truss pivotally connected to said aft ladder legs at an intermediate portion of the latter, said truss being made of two sections and including hinge means interconnecting said sections for pivotal forward movement of said truss sections from a fully-extended truss position in which said sections are in end-to-end alignment to a folded truss position, said forward movement of said truss sections producing relative lateral movement of said end ladders from spaced-apart positions one toward the other to contiguous positions, and hinge means locking means to releasably fixedly immobilize said truss sections in said fully-extended truss position, each truss section having a top horizontal bar and wherein said hinge means locking means is a channel member, of U-shape cross-section, removably engaging the inner end portions of opposite said top bars and lockingly connecting the same in alignment, said channel member being permanently pivotally connected to one of the two opposite said top bars by a retention pin, said retention pin having an upper end fixedly connected to the inner face of said channel member, said retention pin extending through corresponding bores in one of said top bars, said retaining pin having a head at the lower end thereof and being long enough to allow up-and-down movements of said channel member, in order to allow engagement and disengagement thereof from said top bars, and, wherein following disengagement of said channel member from said top bars, a 180° rotation of said channel member about the axis of said retention pin, allows engagement of said channel member over said one top bar.

3. The scaffold of claim 2, wherein each truss section further includes a lower horizontal bar connected to the horizontal top bar by a vertical outer sleeve and a vertical inner rod, said sleeve rotatably surrounding said aft leg between two said step rods of one said ladder and said hinge means consisting of a double tube rotatably surrounding the adjacent vertical inner rods of the two truss sections.

* * * * *